United States Patent [19]

Kobayashi

[11] Patent Number: 4,986,236

[45] Date of Patent: Jan. 22, 1991

[54] IDLE SPEED CONTROL APPARATUS

[75] Inventor: Yoshiyuki Kobayashi, Shizuoka, Japan

[73] Assignee: Suzuki Jidosha Kogyo Kabushiki Kaisha, Shizuoka, Japan

[21] Appl. No.: 469,040

[22] Filed: Jan. 23, 1990

[30] Foreign Application Priority Data

Jan. 31, 1989 [JP] Japan ..... 1-21535

[51] Int. Cl.[5] ..... F02D 41/16

[52] U.S. Cl. ..... 123/339

[58] Field of Search ..... 123/339, 352, 585

[56] References Cited

U.S. PATENT DOCUMENTS 4,364,347 12/1982 Miyagi ..... 123/339
4,617,890 10/1986 Kabayashi et al. ..... 123/339

FOREIGN PATENT DOCUMENTS 60-93164 5/1985 Japan .
60-98157 6/1985 Japan .
61-250360 11/1986 Japan ..... 123/339

*Primary Examiner*—Andrew M. Dolinar
*Attorney, Agent, or Firm*—Flynn, Thiel, Boutell & Tanis

[57] ABSTRACT

An idle speed control apparatus for controlling the idle speed of an internal combustion engine includes a main inlet air passage, a throttle valve positioned in the main air passage, a bypass air passage connected to the main air passage and bypassing the throttle valve, a control valve positioned in the bypass air passage, and an auxiliary bypass air passage which bypasses both the throttle valve and the control valve. The control valve is responsive to a control signal to control air flow in the bypass air passage and regulate the idle speed of the engine. A manually operable mechanism is provided in the auxiliary air passage for manually controlling air flow therethrough and adjusting the engine idle speed. A first control signal causes the control valve to maintain the idle speed within a normally desired range. To facilitate manual adjustment of the idle speed, an arrangement is provided which permits manual generation of a selection signal indicating that manual adjustment of the idle speed is desired. A second control signal is produced in response to the selection signal and causes the control valve to maintain the idle speed within a reduced range which is substantially smaller than the normally desired range.

3 Claims, 3 Drawing Sheets

F/B CONSTANT SMALL

IDLE SPEED CONTROL APPARATUS

FIELD OF THE INVENTION

This invention relates to an idle speed control apparatus and particularly to an idle speed control apparatus capable of correctly regulating a target idle speed.

BACKGROUND OF THE INVENTION

There are some internal combustion engines which are provided with an idle speed control apparatus for controlling idle speed. The idle speed control apparatus includes a bypass inlet air passage for communicating with a main inlet air passage and bypassing an inlet throttle valve therein, and a bypass inlet air quantity control valve disposed in this bypass inlet air passage. The idle speed of the internal combustion engine is feedback controlled to a target idle speed by this bypass inlet control valve. The idle speed control apparatus also includes an auxiliary bypass inlet air passage for communicating with said bypass inlet air passage and bypassing said bypass inlet control valve. An auxiliary bypass inlet air quantity adjusting apparatus is disposed in this auxiliary bypass inlet air passage, with said target idle speed being regulated by this auxiliary bypass inlet control apparatus.

As examples of such idle speed control apparatus, there is one in which the idle speed is maintained constant by presetting an air quantity corresponding to a particular electric load into an arithmetic sequence unit and when the particular load is on or off, controlling an air bypass shutter means of the throttle valve so that the preset air quantity can be obtained (Japanese Patent Early Laid-open Publication No. Sho 60-93164). Another apparatus includes inlet air and fuel bypass passages communicating with the downstream side of a throttle valve from atmosphere and a fuel tank respectively, these bypass passages being interlockingly opened and closed to control the idle speed (Japanese Patent Early Laid-open Publication No. Sho 60-98157).

There are two cases for regulating the target idle speed by the auxiliary bypass inlet control apparatus when a maintenance inspection or repair work, etc., is to be performed. In one case, the auxiliary bypass inlet air quantity is regulated to regulate the target idle speed while the feedback control of the bypass inlet control valve is stopped to allow a fixed control. In the other case, the auxiliary bypass inlet air quantity is regulated to regulate the target idle speed while feedback control is performed by the bypass inlet control valve.

However, there is a case where even when the auxiliary bypass inlet air quantity is regulated by the auxiliary bypass inlet control apparatus while feedback control is performed by the bypass inlet control valve, the target idle speed cannot be regulated correctly. This occurs because when the bypass inlet control valve performs feedback control, if the sensitivity of the control is made sharp, hunting takes place and in order to prevent this, a certain range or blind section of engine speeds is established and extends from the overspeed side of the target idle speed to the underspeed side thereof. This blind section is also provided to prevent hunting under normal engine operational conditions, such as when the engine returns to idle from a high speed condition.

For example, as shown in FIG. 6, when an engine speed blind section $A_1$ of ±50rpm is provided with respect to a target idle speed of 800rpm, if the idle speed is within the engine speed blind section $A_1$ of 100rpm, feedback control is not performed by the bypass inlet control valve even if the auxiliary bypass inlet air quantity is regulated by the auxiliary bypass control apparatus. As a result, a correct regulation to the target idle speed is unobtainable.

Therefore, the object of the present invention is to provide an idle speed control apparatus in which when the target idle speed is regulated by the auxiliary bypass inlet control apparatus, the target idle speed can be regulated correctly while feedback control is being performed by the bypass inlet control valve.

SUMMARY OF THE INVENTION

In attempting to achieve this object, there is provided an idle speed control apparatus for feedback controlling the idle speed of an internal combustion engine to a target idle speed using a bypass inlet control valve disposed in a bypass inlet air passage which communicates with a main inlet air passage and bypasses an inlet throttle valve of the internal combustion engine. The target idle speed is also regulated by an auxiliary bypass inlet regulating device disposed in an auxiliary bypass inlet air passage which communicates with said bypass inlet air passage and bypasses said bypass inlet control valve. A control means is provided for controlling such that when said target idle speed is regulated by said auxiliary bypass inlet regulating device, an engine speed blind section with respect to said target idle speed becomes small when said bypass inlet control valve performs feedback control in response to an input signal representing a predetermined target idle speed.

DETAILED DESCRIPTION

Figure 1:
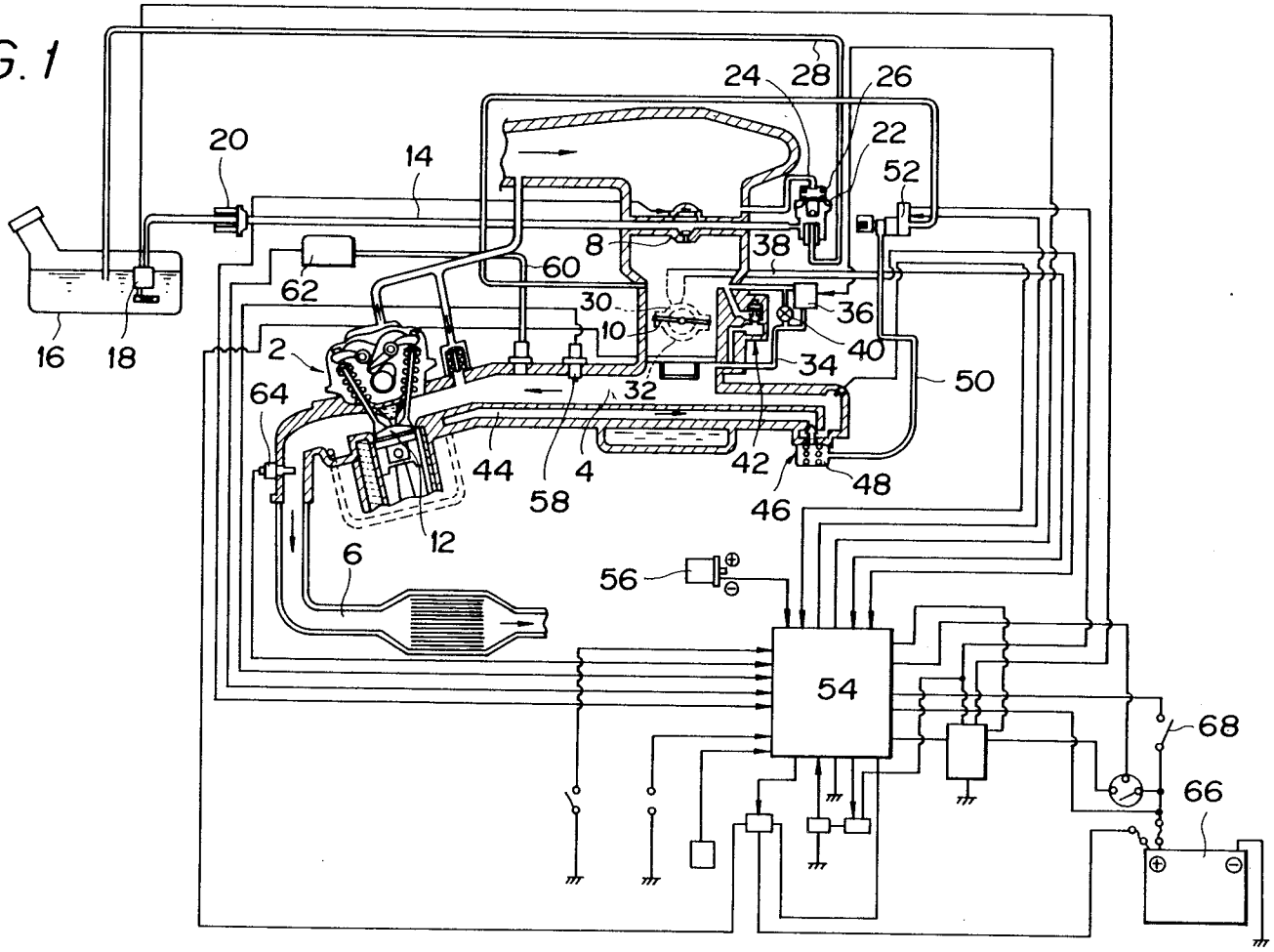
FIG. 1 is a schematic view showing the construction of an idle speed regulating apparatus according to the present invention.

In FIG. 1, the numeral 2 denotes an internal combustion engine, 4 a main or primary inlet air passage, and 6 a discharge passage. The inlet air passage 4 is provided with a fuel injection valve 8 and an inlet throttle valve 10 arranged in this order from the upstream side. Fuel injected by the fuel injection valve 8 is mixed with air to generate a fuel-air mixture. The fuel-air mixture is regulated in quantity by the inlet throttle valve 10 and supplied to a combustion chamber 12 and combusted. The exhaust gas generated as a result of the combustion is discharged outside through the discharge passage 6.

The fuel injection valve 8 constituting a fuel injection apparatus as a fuel supply apparatus communicates with a fuel tank 16 through a fuel supply passage 14. Fuel from the fuel tank 16 is fed under pressure by a fuel pump 18. The fuel is filtered by a fuel filter 20 and supplied to the fuel injection valve 8. The fuel supply passage 14 is provided with a fuel regulator 22. The fuel regulator 22 is designed such that intake pressure is introduced into a pressure chamber 26 through a pressure introduction passage 24. One end of the passage 24 communicates with the inlet air passage 4 on the upstream side of the throttle valve 10 in order to regulate the regulator according to a predetermined pressure and excess fuel is returned to the fuel tank 16 through a fuel return passage 28. The fuel injection valve 8 is connected to a control means 54 (as described hereinafter) and is actuated thereby in accordance with the operational state of the internal combustion engine in order to inject fuel.

The inlet throttle valve 10 is provided with an idle switch 30 which is turned ON when the inlet throttle valve 10 is opened to an idle opening degree (i.e. position) and which is turned OFF when the inlet throttle valve 10 is opened more than the idle opening degree. An opening degree sensor 32 detects the opening degree of the inlet throttle valve 10.

Figure 3:
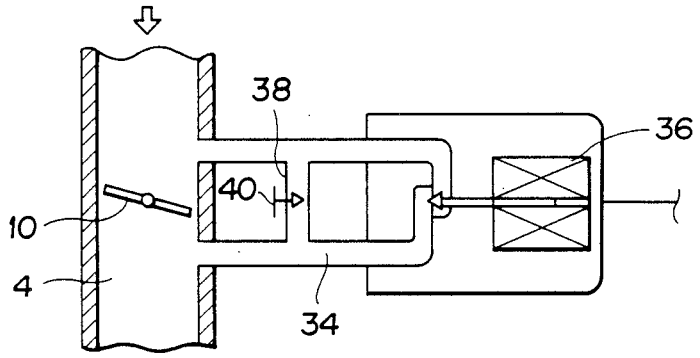
FIG. 3 is an enlarged explanatory view showing a portion of the bypass inlet air passage of the apparatus of FIG. 1.

The inlet air passage 4, as shown in FIG. 3, is provided with a bypass inlet air passage 34 for communicating the upstream side of the inlet throttle valve 10 and the downstream side thereof while bypassing the inlet throttle valve 10. This bypass passage 34 is provided with a bypass inlet air quantity control valve 36. The bypass inlet control valve 36 is adapted to control, in feedback fashion, the idle speed of the internal combustion engine 2 to a target idle speed by opening and closing when the idle speed is required to be regulated, for example at starting or at high engine temperatures or due to an increase in electric load. Also, the bypass passage 34 is provided with an auxiliary bypass inlet air passage 38 bypassing the bypass inlet control valve 36. This auxiliary bypass passage 38 is provided with a manually adjustable auxiliary bypass screw 40 as an auxiliary bypass inlet air quantity regulating device. At maintenance inspection or during repair work, the target idle speed is regulated by this auxiliary bypass screw 40. The numeral 42 (FIG. 1) denotes an air regulator.

The discharge air passage 6 is also provided with a discharge air circulation passage 44 which constitutes a discharge air circulation apparatus as an EGR (exhaust gas recirculation) apparatus. One end of passage 44 communicates with the discharge air passage 6, and the other end communicates with the inlet passage 4 downstream of the throttle valve 10. In the middle of the discharge air circulation passage 44, an EGR regulating valve 46 is disposed. A pressure chamber 48 of the EGR regulating valve 46 communicates with one end of a pressure passage 50, the other end of which communicates with the inlet air passage 4 upstream of the throttle valve 10. In the middle of this pressure passage 50, a pressure control valve 52 is disposed. This pressure control valve 52 is connected with the control means 54 as described hereinafter and is opened and closed in accordance with the operational state of the internal combustion engine 2 in order to actuate the EGR regulating valve 46 to regulate the discharge air circulation quantity.

Such devices as the fuel injection valve 8, fuel pump 18, idle switch 30, opening degree sensor 32, bypass inlet air quantity control valve 36, and pressure control valve 52 are connected with and controlled by the control means 54. Also, the control means 54 is connected with an ignition coil 56 for detecting an ignition signal, engine speed, etc., an inlet air temperature sensor 58 disposed in the inlet air passage 4 for detecting the inlet air temperature, a pressure sensor 62 for detecting intake pressure as introduced by a pressure detecting passage 60 which communicates with the inlet air passage 4, an oxygen sensor 64 disposed in such a manner as to face the discharge air passage 6 to detect the density of oxygen in the discharged gases, a battery 66 as a power source, a regulating switch 68 for inputting a predetermined target idle speed regulating signal, and the like. Switch 68 can be manually controlled (i.e. closed) by the servicing mechanic. Rather than using the regulating switch 68, the target idle speed regulating signal may be input by shorting together appropriate wires of a wiring harness (not shown). The control means 54 controls the idle speed such that when the target idle speed is regulated by the auxiliary bypass screw 40, an engine speed blind section with respect to the target idle speed becomes small when the bypass control valve 36 performs feedback control in response to a predetermined target idle speed regulating signal from the regulating switch 68.

Figure 2:
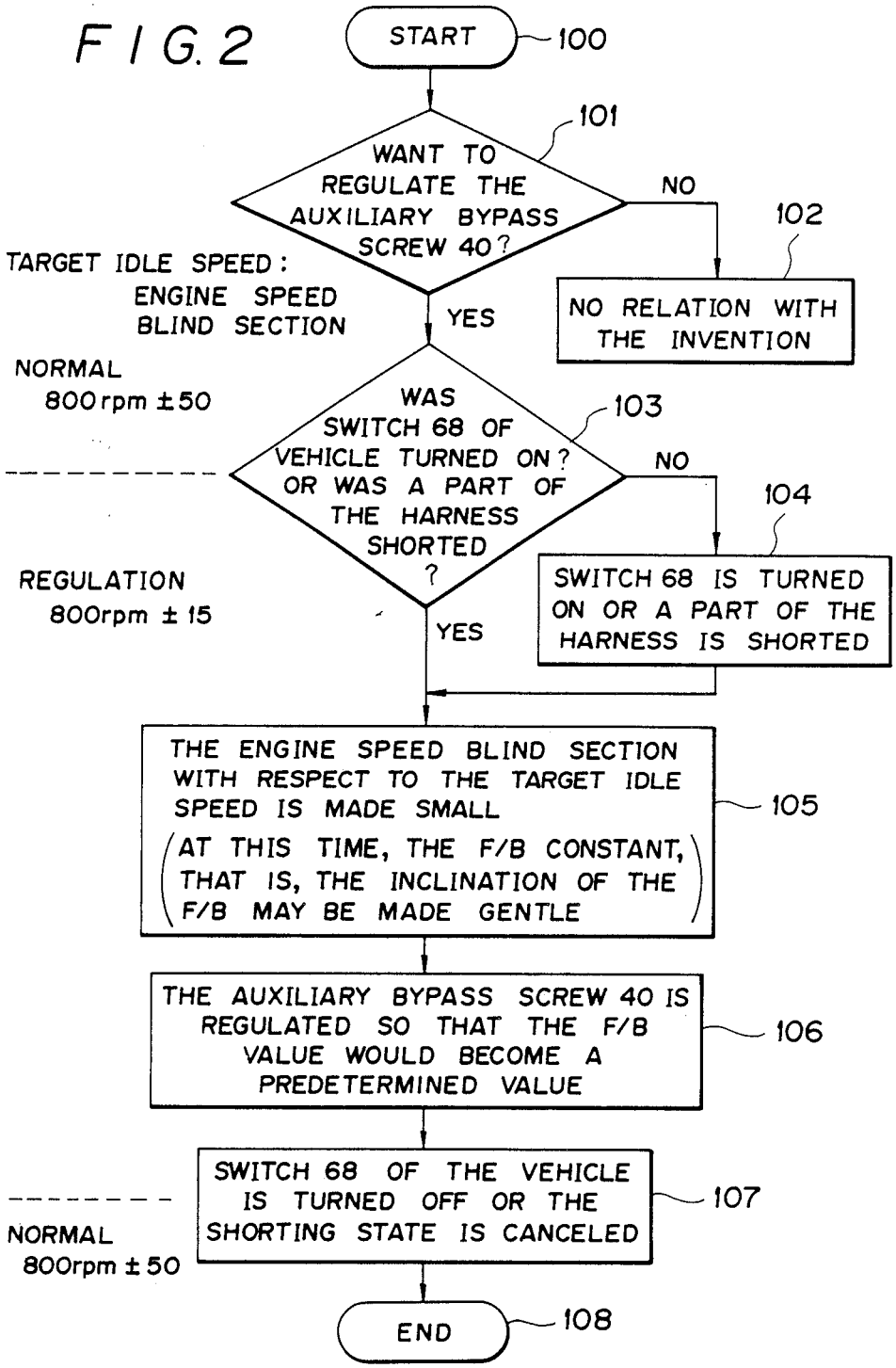
FIG. 2 is a flow chart of the controlling carried out by the apparatus of FIG. 1.

The operation will now be described with reference to FIG. 2.

When the control starts (step 100), it is judged whether the target idle speed is to be regulated by the auxiliary bypass screw 40 (step 101). In case that the target idle speed is not regulated, the target idle speed is controlled separately because it has no relation (step 102) with this control.

When the target idle speed is to be regulated by the auxiliary bypass screw 40, it is judged whether the regulating switch 68 has been turned ON (step 103). Or when the target idle speed regulating signal is to be input by shorting a part of the harness, it is judged whether the part of the harness has been shorted.

When the judgment in step 103 is NO, the regulating switch 68 is turned ON (step 104) or a part of the harness is shorted and then it goes to step 105.

When the judgment in step 103 is YES, it controls the bypass inlet control valve 36 so that the engine speed blind section with respect to the target idle speed becomes a small range when the bypass inlet control valve 36 performs feedback control.

Figure 4:
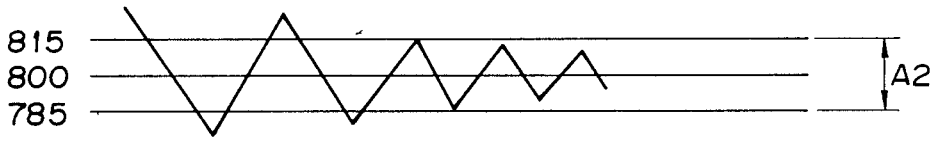
FIG. 4 is an explanatory graphic view of the engine speed blind section.
Figure 5:
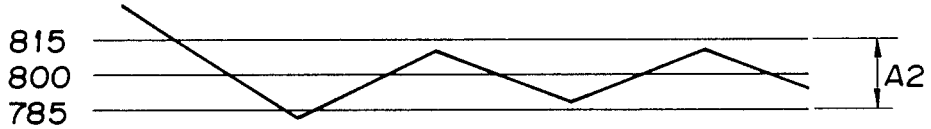
FIG. 5 is an explanatory graphic view of the engine speed blind section in which the feedback constant is made small.
Figure 6:
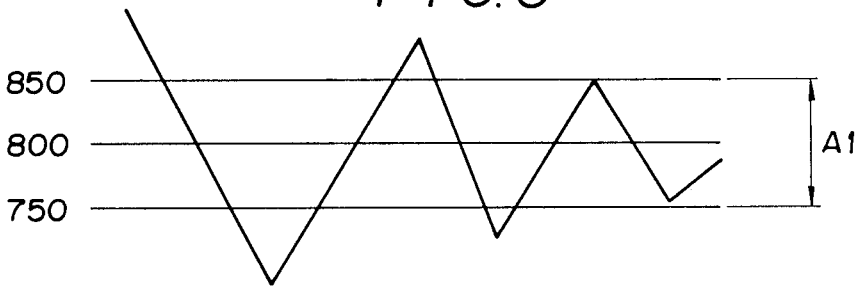
FIG. 6 is an explanatory graphic view of a normal engine speed blind section.

For example, the control means 54 controls such that, as shown in FIG. 6, the normal ±50rpm range with respect to the target idle speed of 800rpm, that is, the engine speed blind section $A_1$ of 100rpm becomes a small engine speed blind section $A_2$ of ±15rpm, that is, a range of 30rpm as shown in FIG. 4. At this time, as shown in FIG. 5, the feedback constant is made small, that is, the inclination or slope of the feedback may be made gentle (i.e. the feedback changes the engine speed at a slower rate). By this, hunting becomes difficult to occur.

The auxiliary bypass screw 40 is regulated (step 106) in accordance with this small engine speed blind section $A_2$.

Upon completion of the regulation, the regulating switch 68 is turned OFF (step 107), or the shorting state of the harness is cancelled to go to END (step 108). By this, the small engine speed blind section $A_2$ of 30rpm with respect to the target idle speed is cancelled and the normal engine speed blind section $A_1$ of 100rpm is restored.

The reason is that when it returns to an idling speed from a high engine speed, like after highway travelling, unless the engine speed blind section with respect to the target idle speed is returned and maintained at the larger range of ±50rpm or so, hunting is easy to occur. However, when the idle speed is regulated, as the engine speed is small in variation, hunting is difficult to occur even if the engine speed blind section with respect to the target idle speed is made small. At this time, if the feedback constant is made small, hunting becomes more difficult to occur.

In this way, by inputting the predetermined idle speed regulating signal by turning the regulating switch 68 ON and controlling the bypass inlet control valve 36 such that the engine speed blind section $A_1$ with respect to the target idle speed becomes small, such as the blind section $A_2$, when the bypass inlet control valve 36 performs feedback control, the target idle speed can be regulated to the small engine speed blind section $A_2$ without inviting the hunting.

Due to the foregoing, during maintenance inspection or repair work, the target idle speed can be regulated correctly by the auxiliary bypass screw 40.

It should be evident that the control means 54 may be implemented using a conventional microprocessor circuit.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an idle speed control apparatus for feedback controlling the idle speed of an internal combustion engine to a target idle speed by a bypass inlet rate control valve disposed in a bypass inlet air passage for communicating a main inlet air passage bypassing an inlet throttle valve of the internal combustion engine and regulating said target idle speed by an auxiliary bypass inlet air quantity regulating device disposed in an auxiliary bypass inlet air passage for communicating said bypass inlet air passage bypassing said bypass inlet air quantity control valve, the improvement comprising control means for controlling such that when said target idle speed is regulated by said auxiliary bypass inlet air quantity regulating device, an engine speed blind section with respect to said target idle speed becomes a small engine speed range when said bypass inlet air quantity control valve is feedback controlled by inputting a predetermined target idle speed regulating signal.

2. In an idle speed control apparatus for controlling the idle speed of an internal combustion engine, including a main inlet air passage for supplying air to be mixed with fuel, a throttle valve positioned in said main inlet passage, a bypass air passage having first and second ends which communicate with said main air passage respectively upstream and downstream of said throttle valve, a bypass inlet control valve positioned in said bypass air passage between said first and second ends thereof, means for applying a control signal to said bypass control valve, said bypass control valve including means responsive to said control signal for controlling air flow through said bypass air passage and regulating the idle speed of the engine, an auxiliary bypass air passage having first and second ends which respectively communicate with said first and second ends of said bypass air passage so as to also communicate with said main air passage respectively upstream and downstream of said throttle valve, manually operable means disposed in said auxiliary bypass air passage for manually controlling air flow therethrough and manually adjusting the engine idle speed, and means for producing a first said control signal such that said bypass control valve maintains the engine idle speed within a normally desired range of idle speeds, the improvement comprising:

means for facilitating accurate manual adjustment of the engine idle speed including means for permitting manual generation of a manual adjustment selection signal which indicates that manual adjustment of the engine idle speed is desired, and means for producing a second said control signal in response to said manual adjustment selection signal such that said bypass control valve maintains the engine idle speed within a reduced range of idle speeds which is substantially smaller than said normally desired range of idle speeds.

3. A method for accurately manually adjusting the idle speed of an internal combustion engine, said engine including a main inlet air passage for supplying air to be mixed with fuel, a throttle valve positioned in said main inlet passage, a bypass air passage having first and second ends which communicate with said main air passage respectively upstream and downstream of said throttle valve, a bypass inlet control valve positioned in said bypass air passage between said first and second ends thereof, means for applying a control signal to said bypass control valve, said bypass control valve including means responsive to said control signal for controlling air flow through said bypass air passage and regulating the idle speed of the engine, an auxiliary bypass air passage having first and second ends which respectively communicate with said first and second ends of said bypass air passage so as to also communicate with said main air passage respectively upstream and downstream of said throttle valve, manually operable means disposed in said auxiliary bypass air passage for manually controlling air flow therethrough and manually adjusting the engine idle speed, and means for producing a first said control signal such that said bypass control valve maintains the engine idle speed within a normally desired range of idle speeds, comprising the steps of:

providing means for permitting manual generation of a manual adjustment selection signal which indicates that manual adjustment of the engine idle speed is desired;

providing means for producing a second said control signal in response to said manual adjustment selection signal such that said bypass control valve maintains the engine idle speed within a reduced range of idle speeds which is substantially smaller than said normally desired range of idle speeds;

manually generating said manual adjustment selection signal; and using said manually operable means to manually adjust the engine idle speed.

* * * * *